US006915970B2

(12) United States Patent
Iyoda et al.

(10) Patent No.: US 6,915,970 B2
(45) Date of Patent: Jul. 12, 2005

(54) DEVICE FOR VIBRATINGLY SMASHING SAND MASSES

(75) Inventors: Yoshiji Iyoda, Toyokawa (JP); Akito Suzuki, Toyokawa (JP); Tadashi Sugiura, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 181 days.

(21) Appl. No.: 10/300,750

(22) Filed: Nov. 21, 2002

(65) Prior Publication Data

US 2003/0094523 A1 May 22, 2003

(30) Foreign Application Priority Data

Nov. 22, 2001 (JP) ..... 2001-356818
Oct. 21, 2002 (JP) ..... 2002-305481

(51) Int. Cl.[7] ..... B22D 29/02

(52) U.S. Cl. ..... 241/69; 241/DIG. 10; 164/412

(58) Field of Search ..... 241/27, 74, 69, 241/94, 284, DIG. 10; 164/412

(56) References Cited

U.S. PATENT DOCUMENTS 3,762,656 A 10/1973 Deve ..... 241/60
4,324,367 A * 4/1982 Bowling et al. ..... 241/60
5,423,370 A * 6/1995 Bonnemasou et al. ..... 164/132

FOREIGN PATENT DOCUMENTS

GB 1 605 129 12/1981
JP 57-116366 7/1982
JP 5-93650 12/1993
JP 11-276922 10/1999

* cited by examiner

*Primary Examiner*—Lowell A. Larson
(74) *Attorney, Agent, or Firm*—Finnegan, Henderson, Farabow, Garrett & Dunner, L.L.P.

(57) ABSTRACT

An apparatus for vibratingly smashing sand masses, comprising a sand tank (30) elastically supported and having an inner tank (33) therein for holding sand masses; and vibrating means (21) having unbalanced weights for vibrating the sand tank, including the inner tank, by rotating the unbalanced weights, such that the vibrations of the sand tank draw a Lissajous's figure of approximately a circle. The inner tank (33) is defined by a wall (31) disposed in the sand tank apart from the inner surface (30A) of the sand tank (30), the wall (31) having a plurality of apertures (32).

4 Claims, 1 Drawing Sheet

DEVICE FOR VIBRATINGLY SMASHING SAND MASSES

FIELD OF THE INVENTION

This invention relates to an apparatus for vibratingly smashing sand masses.

DESCRIPTION OF THE PRIOR ART

JP 57-116366 U discloses a device for vibratingly smashing sand masses. Further, JP 5-93650 U(JP 7-1844 Y) discloses a device for vibratingly separating a sand mold and an as-cast product from a flask by vibratingly applying forces to the sand mold and flask.

The device of JP 57-116366 U includes a box-like sand tank, for holding sand masses, that is elastically supported. The sand tank is vibrated vertically or slantingly to vibrate the sand masses in the sand tank vertically or slantingly to smash them. The device requires large motors and therefore it becomes large and thus necessitates a large space for its installation.

The device of JP 5-93650 U includes a hollow support dish supported by columns and having upper and lower openings and beams disposed in the upper opening for receiving a flask that holds a sand mold and an as-cast product, an accommodating portion for receiving the broken pieces of the flask and the sand mold, the accommodating portion being elastically supported under the lower opening, a vibrating device mounted on the accommodating portion for vertically vibrating the accommodation portion, and an upright frame mounted on the accommodating portion and extending through the lower opening to a level that is slightly higher than the upper surfaces of the beams, for vibratingly applying forces to the flask. However, in the device for vibratingly separating the sand mold from the flask, the broken pieces of the sand mold to be discharged from the device are relatively large masses. Thus, to reclaim the sand masses, more devices are required, i.e., one for smashing the sand masses into sand particles and another for transferring the sand masses to this smashing device. The combination of these devices becomes large.

SUMMARY OF THE INVENTION

The present invention has been conceived to overcome the drawbacks of the prior-art devices discussed above.

The purpose of the present invention is to provide a compact device that can smash sand masses into sand particles.

Another purpose of the present invention is to provide a compact device for separating a sand mold, an as-cast product, etc., from a flask and for smashing the sand mold into sand particles.

The device of the present invention has unbalanced-weight-type vibrating means having unbalanced weights for vibrating a mechanism (or means) by rotating the unbalanced weights, such that the vibrations of the mechanism draw a Lissajous's figure of approximately a circle.

In one aspect of the present invention, an apparatus for vibratingly smashings and masses is provided. It comprises as and tank elastically supported and having therein an inner tank for holding sand masses, the inner tank being defined by a wall disposed in the sand tank apart from the inner surface of the sand tank, the wall having a plurality of apertures, and unbalanced-weight-type vibrating means having unbalanced weights for vibrating the sand tank, including the inner tank, by rotating the unbalanced weights, such that the vibrations of the sand tank draw a Lissajous's figure of approximately a circle.

In another aspect of the present invention, an apparatus for separating a sand mold and an as-cast product from a flask and for smashing the separated sand mold is provided. The apparatus comprises a support dish mechanism fixedly supported and having an upper opening, a lower opening, an internal space extending between the upper opening and the lower opening, and a plurality of support members positioned in the upper opening, the support members having top surfaces arranged in a horizontal plane for supporting the flask that holds the sand mold, the as-cast product, any tool to assist in constructing the sand mold, and any foreign body, a separating mechanism elastically supported under the support dish mechanism and having means for smashing the sand masses of the sand mold into sand particles and for removing the as-cast product, the foreign body, and the tool, unbalanced-weight-type vibrating means mounted on the separating mechanism and having unbalanced weights for vibrating the separating mechanism by rotation thereof such that the vibrations of the separating mechanism draw a Lissajous's figure of approximately a circle, a plurality of upright members mounted on the separating mechanism and extending through the internal space of the support dish mechanism between the support members, for vibratingly applying forces to the sand mold and the flask when the separating member is vibrated by the vibrating means, and a smashing mechanism mounted on the upright members for smashing the sand mold that drops from the flask into pieces of sand masses and for allowing the sand masses to drop from the smashing mechanism to the means of the separating mechanism for smashing the sand masses into sand particles.

DESCRIPTION OF THE PREFERRED EMBODIMENTS

The embodiments of the present invention are now explained by reference to the drawings.

Figure 1:
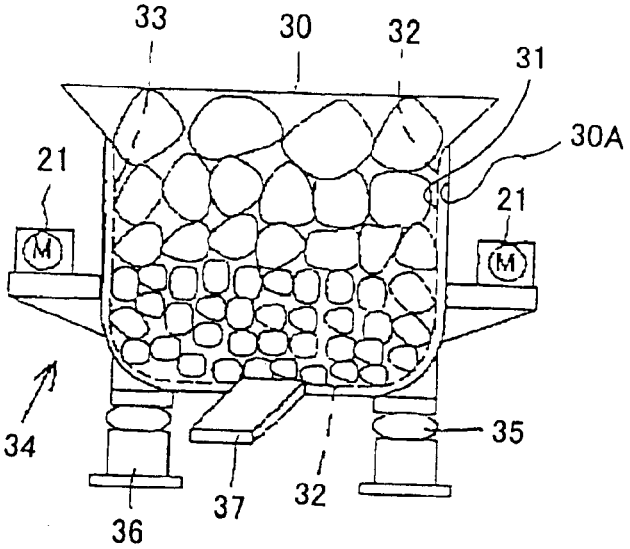
FIG. 1 is a front view, partly in section, of the first embodiment of the apparatus of the present invention.

FIG. 1 shows an embodiment of the apparatus of the present invention for vibratingly smashing sand masses into sand particles. The apparatus includes a box-like sand tank 30 elastically supported. The sand tank 30 has an inner tank 33 in it. As shown in FIG. 1, the inner tank 33 is defined by a wall 31 disposed in the sand tank 30 at a position spaced apart from its inner surface 30A and is centrally located in the sand tank 30 for holding sand masses. The wall 31 has apertures 32 in the shape of slits through which sand particles can pass into the space defined between the wall 31 and the inner surface 30A of the sand tank 33.

The apparatus also includes unbalanced-weight-type vibrating means 34 mounted on the outer surface of the sand tank 30 at both its sides. The vibrating means 34 includes a pair of motors 21, 21 and two pairs of unbalanced weights (not shown), each pair being attached to one motor 21. As will now be explained, the vibrating means 34 are appropriately disposed so that when the motors operate to rotate the unbalanced weights to vibrate the sand tank 30, the vibrations of the sand tank 30, including the inner tank 33, draw a Lissajous's figure of approximately a circle.

The sand tank 30 is elastically mounted on a frame 36 through air springs 35, 35. Further, a chute 37 is disposed at a lower portion of the sand tank 30. The chute 37 is connected to a port for discharging sand particles (not shown) that is located at the lower, central part of the sand tank 33.

The motors 21, 21 are disposed on a horizontal, common axis of rotation, with that axis of rotation passing through the center of gravity of the combination to be vibrated of the sand tank 30 and the sand masses held in the inner tank 33 of the sand tank. Further, the two pairs of unbalanced weights rotate in the same direction at the same speed. Thus, when the unbalanced weights are so rotated, they allow the sand tank 30, including the inner tank 33, to vibrate to draw a Lissajous's figure of approximately a circle and allow the sand particles to flow in a predetermined direction.

In operating the apparatus, a predetermined amount of sand masses is fed into the inner tank 30, and the motors 21, 21 are then operated to rotate all the unbalanced weights in one direction and at the same speed. Thus the sand tank 1, including the inner tank 33, is vibrated to draw a Lissajous's figure of approximately a circle.

When the sand tank 30 is so vibrated, vibrations that include two components, i.e., horizontal and vertical ones, are applied to the sand masses held in the inner tank 33. Accordingly, the sand masses are effectively smashed into sand particles, which pass through the apertures 32 and drop onto the bottom plate of the sand tank, and are then discharged from the chute 37.

For reference and comparison, the performance in smashing of the circular-vibrating apparatus of the present invention and a conventional vibrating device that produces vertical vibrations is shown in Table 1, which is attached at the end of the Description.

As is seen from Table 1, the vibrating apparatus of the present invention has a processing performance double that of the conventional vibrating device, i.e., the performance of the motor of the apparatus of the present invention can be half that of the motor of a conventional vibrating device.

Figure 2:
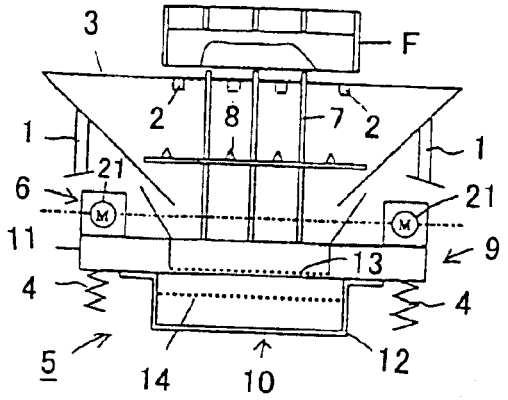
FIG. 2 is a front view, partly in section, of the second embodiment of the apparatus of the present invention.
Figure 3:
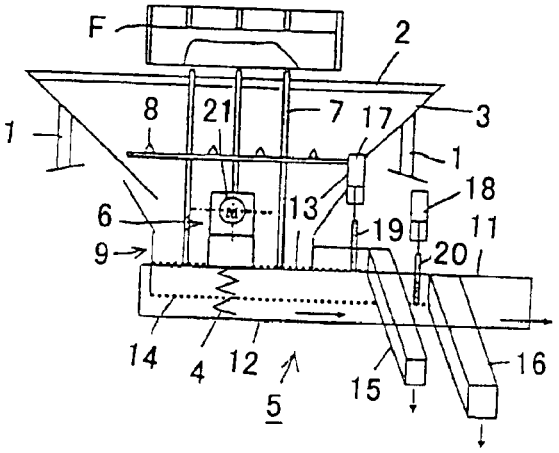
FIG. 3 is a right side view, partly in section, of the apparatus of FIG. 2.

Now the second embodiment of the apparatus of the present invention is explained by reference to FIGS. 2 and 3. The apparatus vibratingly applies forces to a sand mold and a flask F that holds the sand mold, which may hold an as-cast product (the cast itself and a sprue), tools to assist in constructing the sand mold such as a chiller and a core grid, and foreign bodies such as ceramic tubes, fins, cold shots, and dirt, to separate the sand mold from the flask F and then to smash the sand mold into sand particles.

The apparatus includes a support dish mechanism 3 fixedly supported by a plurality of support columns 1, 1 and having an upper opening, a lower opening, an internal space extending between the upper opening and the lower opening, and a plurality of support members 2, 2 in the shape of square bars positioned in the upper opening, the support members 2, 2 having top surfaces arranged in a horizontal plane for supporting the flask F that holds the sand mold, which may hold the as-cast product, the tool to assist in constructing the sand mold, and the foreign body; a separating mechanism 5 elastically supported by a plurality of coil springs 4, 4 under the support dish mechanism 3 and having means for smashing sand masses of the sand mold into sand particles and for removing the as-cast product, the tool, and the foreign body; unbalanced-weight-type vibrating means 6 mounted on the separating mechanism 5 and having unbalanced weights for vibrating the separating mechanism 5 by rotation thereof such that the vibrations of the separating mechanism draw a Lissajous's figure of approximately a circle; a plurality of upright vibrating members 7, 7 mounted on the separating mechanism and extending through the internal space of the support dish mechanism 3 between the support members 2, 2 so that the tops of the upright vibrating members 7, 7 slightly protrude from the top surfaces of the support members 2, 2, for vibratingly applying forces to the sand mold and the flask when the separating mechanism is vibrated by the vibrating means 6; and a smashing mechanism 8 mounted on the upright vibrating members 7, 7 for smashing the sand mold or broken pieces of it that drop from the flask into sand masses and for allowing the sand masses to drop from the smashing mechanism 8 to the means of the separating mechanism 5 for smashing the sand masses into sand particles.

The separating mechanism 5 includes a first removing means 9 for smashing the sand masses of the sand mold into sand particles and for removing the as-cast product and relatively large-sized tools to assist in constructing the sand mold and foreign bodies, and a second removing means 10 located below the first removing means 9, for removing tools to assist in constructing the sand mold or foreign bodies that have not been removed by the first removing means 9.

The first removing means 9 has a tub-shaped body 11 and a metal mesh 13 fixed to the body 11 so that the first removing means can act as a sieve. Similarly, the second removing means 10 has a tub-shaped body 12 attached to the bottom of the tub-shaped body 11 of the first removing means 9. The tub-shaped body 12 has a metal mesh 14 so that it can act as a sieve. The mesh size of the metal mesh 14 of the second removing means 10 is smaller than that of the metal mesh 13 of the first removing means 9. Further, as seen in FIG. 3, a chute 15 and a chute 16 are disposed at the levels of the upper surfaces of the mesh 13 and mesh 14, respectively, and they are connected to discharging ports (not shown) of the mesh 13 and mesh 14, to discharge the tools, etc., that are caught by the meshes 13, 14. The discharging ports are closed by stoppers, or gates, 19, 20 that can be opened and closed by downwardly-facing cylinders 17, 18.

The unbalanced-weight-type vibrating means 6 includes a pair of vibrating motors 21, 21, each of which is provided with a pair of unbalanced weights, and which are disposed on the separating mechanism 5 near both its sides. The motors 21, 21 have a common axis of rotation that passes through the center of gravity of the entire vibrating device, which is elastically mounted on the coil springs 4, 4, consisting of the first and second removing means 9, 10, the upright vibrating members 7, 7, the smashing mechanism 8, the vibrating motors 21, 21, the flask F, and the sand mold in the flask, which holds the as-cast product, etc. Further, two pairs of unbalanced weights of the motors 21, 21 are rotated at the same speed in one direction. Accordingly, when the unbalanced weights so rotate, they allow the first and second removing means 9, 10 to vibrate to draw a Lissajous's figure of approximately a circle and allow the as-cast product, the tools, and the sand particles to be transferred in a predetermined direction.

Now the process by using the apparatus to separate the sand mold from the flask F and to smash the sand mold into sand particles and to expose the as-cast product and the tools, is explained.

First, a flask F that holds a sand mold, which holds an as-cast product, the tools, etc., is placed on the support members 2, 2, and the pair of motors 21, 21 are then operated to rotate the unbalanced weights in one direction at the same speed. Thus the upright vibrating members 7, 7, the smashing mechanism 8, the first and second removing means 9, 10 of the separating mechanism 5, etc., vibrate to draw a Lissajous's figure of approximately a circle.

Accordingly, the upright vibrating members 7, 7 apply vibrations to the sand mold and the flask F, wherein the vibrations have horizontal and vertical components, and the sand mold, which may include the as-cast product, the tools, and foreign bodies are separated from the flask F and drop onto the smashing mechanism 8. Thus the sand mold is broken into pieces of sand masses, and these masses, the as-cast product, the tools, the foreign bodies, etc., drop onto the separating mechanism 5.

The sand masses, the as-cast product, the tools, the foreign bodies, etc., which have dropped onto the separating mechanism 5, are stopped by the gate 19 in the first removing means 9, and hit each other there. Thus the sand masses are smashed into sand particles, and the sand particles and relatively small tools and foreign bodies pass through the metal mesh 13 of the first removing means 9 and fall onto the metal mesh 14 of the second removing means 10. Over a predetermined time, the cylinder 17 is operated to open the gate 19. Thus the as-cast product, the tools, the foreign bodies, etc. that could not pass through the metal mesh 13 move on the metal mesh 13 and are discharged from the gate 19 by using the chute 15.

On the other hand, the sand particles, an as-cast product, tools, foreign bodies, etc. that have dropped onto the metal mesh 14 of the second removing means 10 hit each other in a manner similar to those on the metal mesh 13 of the first removing means 9. Thus the sand particles are further smashed into fine particles, and they pass through the metal mesh 14 onto the bottom plate of the second removing means 10 and are then transferred. The as-cast product, the tools, the foreign bodies, etc. that could not pass through the metal mesh 14 move on the metal mesh and are discharged by the chute 16.

It should be understood that the embodiments described above are exemplary only, and many variations can be made to them. Thus the present invention includes such variations, and the scope of the invention is defined by the attached claims.

For example, although in the second embodiment the stoppers (gates) are used for the first and second removing means 9, 10 of the separating mechanism 5, these stoppers may be eliminated if the first and second removing means are long and can sufficiently smash the sand masses into sand particles.

TABLE 1

| Type of vibrations | Acceleration (G) | Number of rotations of motors (rpm) | Amplitudes (mm) | Amount of fed sand (kg) | Vibrating time (sec) | Amount of smashed sand: Weight (kg) | Amount of smashed sand: Rate |
|---|---|---|---|---|---|---|---|
| Circular vibrations | 2.5 | 1300 | x = 3.5<br>Y = 2.6 | 15.8 | 120 | 8.1 | 1.8 |
| Vertical vibrations | 2.5 | 1300 | Y = 2.6 | 15.8 | 120 | 4.5 | 1 |

Remark:
Dimension of a sand mass: ϕ50 × 50 h (furan sand mass)

What is claimed is:

1. An apparatus for separating a sand mold and an as-cast product from a flask and for smashing the separated sand mold, comprising:

a support dish mechanism fixedly supported and having an upper opening, a lower opening, an internal space extending between the upper opening and the lower opening, and a plurality of support members positioned in the upper opening, the support members having top surfaces arranged in a horizontal plane for supporting a flask that holds a sand mold, an as-cast product, any tool to assist in constructing the sand mold, and any foreign body;

a separating mechanism elastically supported under the support dish mechanism and having means for smashing sand masses of the sand mold into sand particles and for removing the as-cast product, the foreign body, and the tool;

unbalanced-weight-type vibrating means mounted on the separating mechanism and having unbalanced weights for vibrating the separating mechanism by rotation thereof such that the vibrations of the separating mechanism draw a Lissajous's figure of approximately a circle;

a plurality of upright members mounted on the separating mechanism and extending through the internal space of the support dish mechanism between the support members, for vibratingly applying forces to the sand mold and the flask when the separating mechanism is vibrated by the vibrating means; and a smashing mechanism mounted on the upright members for smashing the sand mold that drops from the flask into pieces of sand masses and for allowing the sand masses to drop from the smashing mechanism to the means of the separating mechanism for smashing the sand masses into sand particles.

2. The apparatus of claim 1, wherein the means for smashing the sand masses of the sand mold into sand particles and for removing the as-cast product, the foreign body, and the tool include a metal mesh or a grating through which the sand particles can pass.

3. The apparatus of claim 1, wherein the smashing mechanism includes two or more vertically arranged and spaced-apart horizontal gratings.

4. The apparatus of claim 1, wherein the means for smashing the sand masses of the sand mold into sand particles and for removing the as-cast product, the foreign body, and the tool include an openable and closable stopper that can temporarily stop the as-cast product, the foreign body, and the tool from being discharged.

* * * * *